US007056017B2

(12) United States Patent
Daniel et al.

(10) Patent No.: US 7,056,017 B2
(45) Date of Patent: Jun. 6, 2006

(54) COOLING SYSTEM AND METHOD FOR AN IMAGING SYSTEM

(75) Inventors: Premjit J. Daniel, Bangalore (IN); Balasubramanian Kandankumarath, Bangalore (IN)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 197 days.

(21) Appl. No.: 10/708,595

(22) Filed: Mar. 12, 2004

(65) Prior Publication Data

US 2005/0201523 A1 Sep. 15, 2005

(51) Int. Cl.
*H01J 35/10* (2006.01)

(52) U.S. Cl. ..... 378/200; 378/141; 378/142; 378/199

(58) Field of Classification Search ..... 378/141, 378/142, 199, 200
See application file for complete search history.

(56) References Cited

U.S. PATENT DOCUMENTS

| | | | | |
|---|---|---|---|---|
| 4,384,360 | A * | 5/1983 | Kitadate et al. | 378/202 |
| 5,222,118 | A * | 6/1993 | Gerth | 378/200 |
| 6,252,937 | B1 * | 6/2001 | Snyder | 378/141 |
| 6,254,272 | B1 * | 7/2001 | Dilick | 378/200 |
| 6,263,046 | B1 * | 7/2001 | Rogers | 378/141 |
| 6,313,990 | B1 * | 11/2001 | Cheon | 361/699 |
| 6,519,317 | B1 * | 2/2003 | Richardson et al. | 378/130 |
| 6,608,429 | B1 * | 8/2003 | Snyder | 313/36 |
| 6,778,635 | B1 * | 8/2004 | Richardson | 378/130 |
| 2004/0218725 | A1 * | 11/2004 | Radley et al. | 378/141 |
| 2004/0264632 | A1 * | 12/2004 | Joshi et al. | 378/19 |
| 2005/0117698 | A1 * | 6/2005 | Lacey et al. | 378/19 |

* cited by examiner

*Primary Examiner*—Allen C. Ho
(74) *Attorney, Agent, or Firm*—Peter Vogel

(57) ABSTRACT

A cooling system for an imaging system includes a mounting plate having a first side and an opposing second side. The mounting plate further defines at least one opening. At least one heat conductor extends through the opening and through at least a portion of a dielectric fluid reservoir defined adjacent the second side of the mounting plate and adapted to enclose an X-Ray source. A heat sink is coupled to the first side of the mounting plate and receives at least a portion of the heat conductor.

18 Claims, 3 Drawing Sheets

COOLING SYSTEM AND METHOD FOR AN IMAGING SYSTEM

BACKGROUND OF INVENTION

The present invention relates generally to imaging systems and more particularly to an improved apparatus for dissipating heat in an imaging system.

Typical fixed X-ray tubes include a beam of electrons directed through a vacuum and across a very high voltage (on the order of 100 kilovolts) from a cathode to a focal spot position on an anode. X-Rays are generated as electrons strike the anode, which typically includes a fixed target track.

The conversion efficiency of X-ray tubes is relatively low, i.e. typically less than 1% of the total power input. The remainder is converted to thermal energy or heat. Accordingly, heat removal, or other effective procedures for managing heat, tends to be a major concern in X-ray system design.

Many X-ray systems include dielectric oil for dissipating heat from the anode. When dielectric oil gets hot, however, it expands. The pressure of the expanding oil must be relieved, or X-Ray tube heads will leak and/or rupture.

Without adequate cooling mechanisms, temperature of the dielectric oil reaches very high values that may limit the continued operation of the equipment in many ways. Some of the major ways operation may be limited include reductions in dielectric strength resulting in oil breakdown and degradation of the polymers used to package the high voltage (HV) X-ray circuit.

Current X-ray systems implementing bipolar technology, wherein positive and negative voltages are applied to an anode and cathode respectively, pose a special challenge for system cooling. Typically, this cooling is attempted through implementation of a rubber or metal membrane that flexes with the expanding dielectric oil.

A difficulty for membranes in X-ray systems is that they must meet stringent X-Ray leakage specifications. This inhibits free flow of oil within the equipment because openings in the X-Ray shield around the tube must be carefully managed to prevent X-ray leakage. Membranes tend to be susceptible to leakage.

Conventional X-ray systems also use oil pumps for drawing hot oil around the X-ray tube. The hot oil is then circulated through a heat exchange system. Heat exchangers tend to be large, heavy, noisy, and generally unreliable.

The disadvantages associated with current X-ray systems have made it apparent that a new technique for HV connection to X-ray systems is needed. The new technique should include robust response to thermal stress and should also prevent material degradation or oil leakage while still maintaining a superior HV performance. The present invention is directed to these ends.

SUMMARY OF INVENTION

In accordance with one aspect of the present invention, a cooling system for an imaging system having an X-Ray source includes a housing for the imaging system defining a dielectric oil reservoir enclosing the X-ray source. A mounting plate is coupled to the housing and has a first side and an opposing second side such that the second side defines a boundary of the dielectric oil reservoir. The mounting plate further defines a plurality of openings spaced apart from each other in an arc formation.

A plurality of heat pipes extend through the plurality of openings whereby the plurality of heat pipes contact the dielectric oil.

A plurality of thermally conductive fins are coupled to the first side of the mounting plate and are arranged parallel thereto. The plurality of thermally conductive fins receive at least a portion of each of the plurality of heat pipes.

A generally arc-shaped thermally conductive sleeve having an interior and an exterior is coupled to the plurality of heat pipes such that the plurality of heat pipes are arranged lengthwise on a surface of the interior. The generally arc-shaped thermally conductive sleeve is enclosed within the housing and at least partially surrounds the X-Ray source.

An X-Ray shield encloses the generally arc-shaped thermally conductive sleeve and is arranged trans-axially therewith within the housing. The X-Ray shield includes a first end and a second end. The first end defines a plurality of openings receiving the plurality of heat pipes and is spaced a distance from the second side of the mounting plate. The first end is coupled to the generally arc-shaped thermally conductive sleeve such that the generally arc-shaped thermally conductive sleeve extends a portion of a distance between the first end and the second end. The second end defines an opening for X-Rays from the X-Ray source to exit the X-Ray shield.

One advantage of the present invention is that cost and weight savings are generated through elimination of pumps and diaphragms.

Another advantage is the potential for diverse system integration as the compact system could be mechanically interfaced with existing systems within their available volumes, as the present invention is relatively compact.

Still another advantage is that X-ray system reliability is increased with the elimination of heat pumps or diaphragms.

Additional advantages and features of the present invention will become apparent from the description that follows and may be realized by the instrumentalities and combinations particularly pointed out in the appended claims, taken in conjunction with the accompanying drawings.

BRIEF DESCRIPTION OF DRAWINGS

For a more complete understanding of the invention, there will now be described some embodiments thereof, given by way of example, reference being made to the accompanying drawings, in which.

DETAILED DESCRIPTION

The present invention is illustrated with respect to an X-ray cooling system, particularly suited to the medical field. The present invention is, however, applicable to various other uses that may require cooling systems, as will be understood by one skilled in the art.

Figure 1:
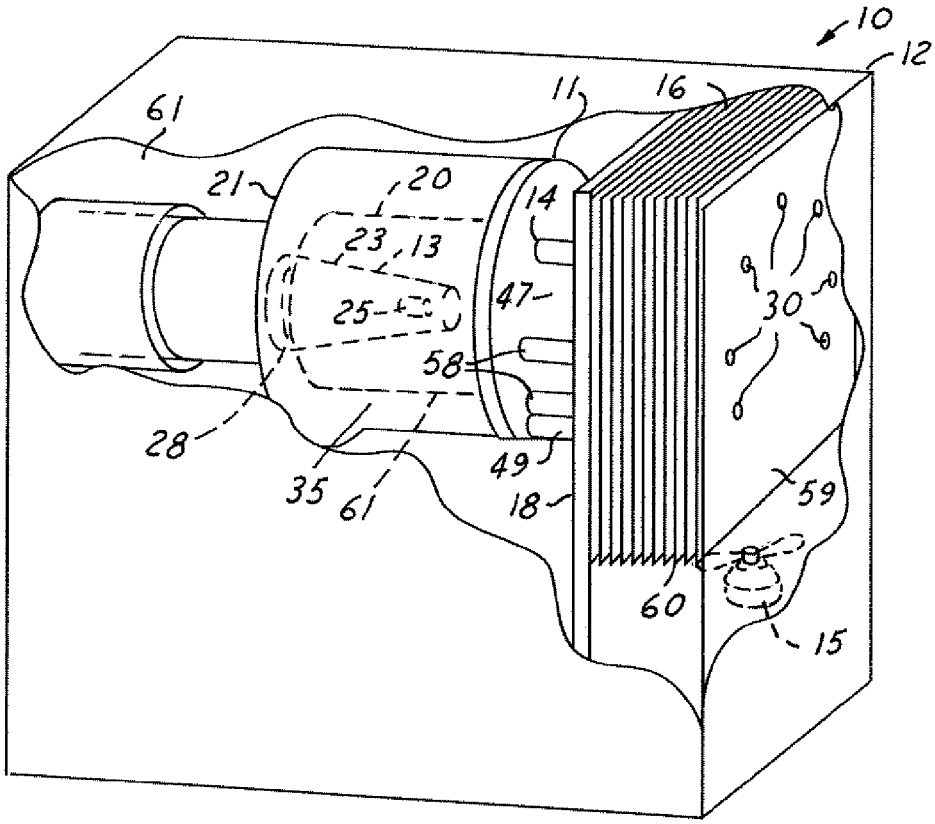
FIG. 1 is a perspective view with a section broken away illustrating an X-ray system according to one embodiment of the present invention.
Figure 2:
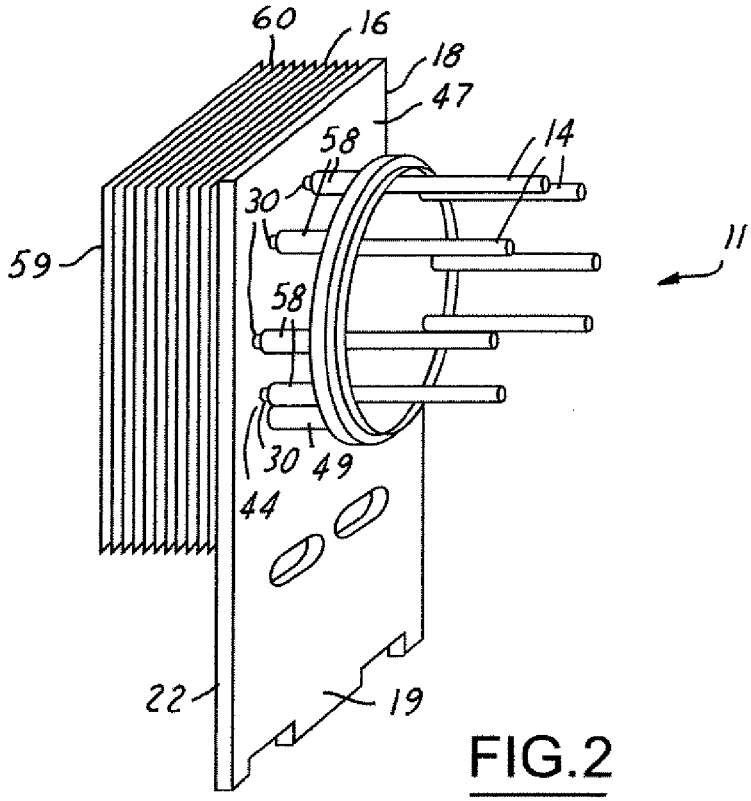
FIG. 2 is a perspective view of a heat pipe system according to FIG. 1.
Figure 3A:
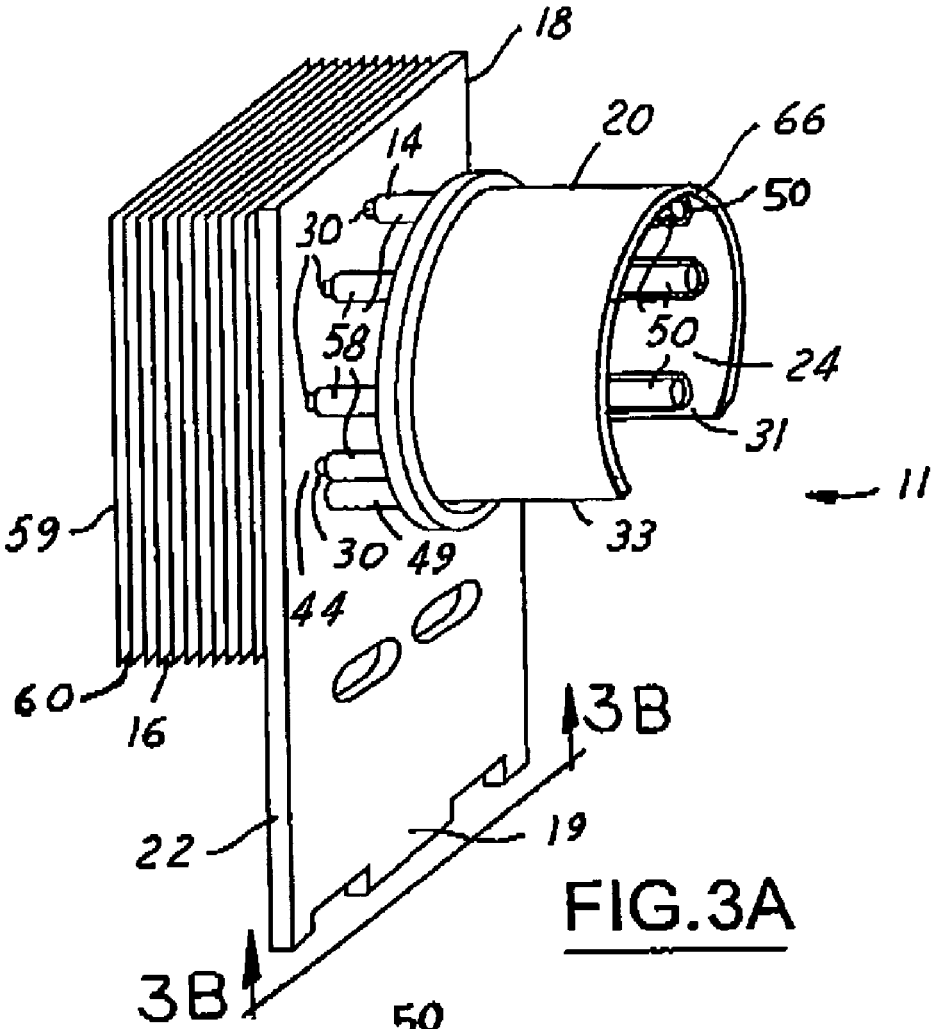
FIG. 3A is a perspective view of the heat pipe system of FIG. 2 including a copper sleeve.
Figure 3B:
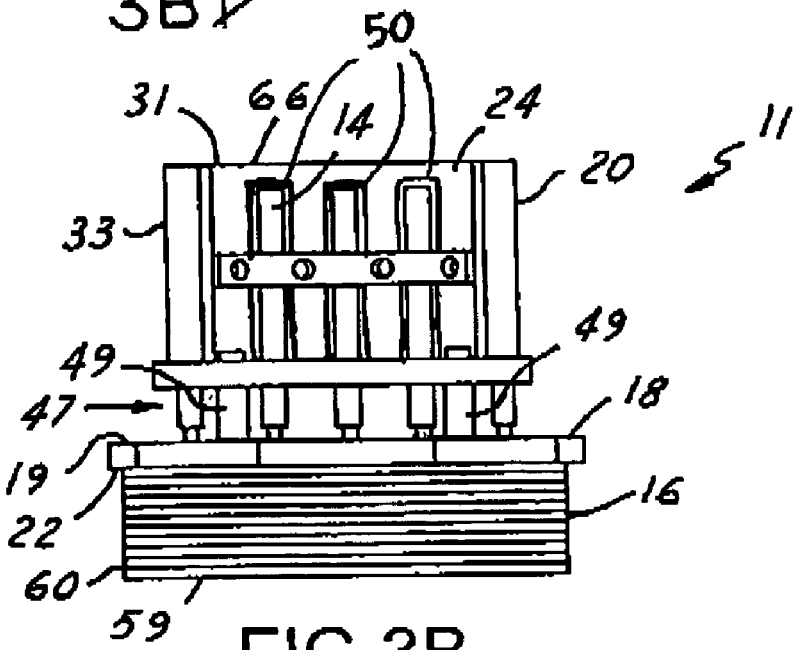
FIG. 3B is a base view of the heat pipe system of FIG. 3A looking in the direction of line 3B.
Figure 4:
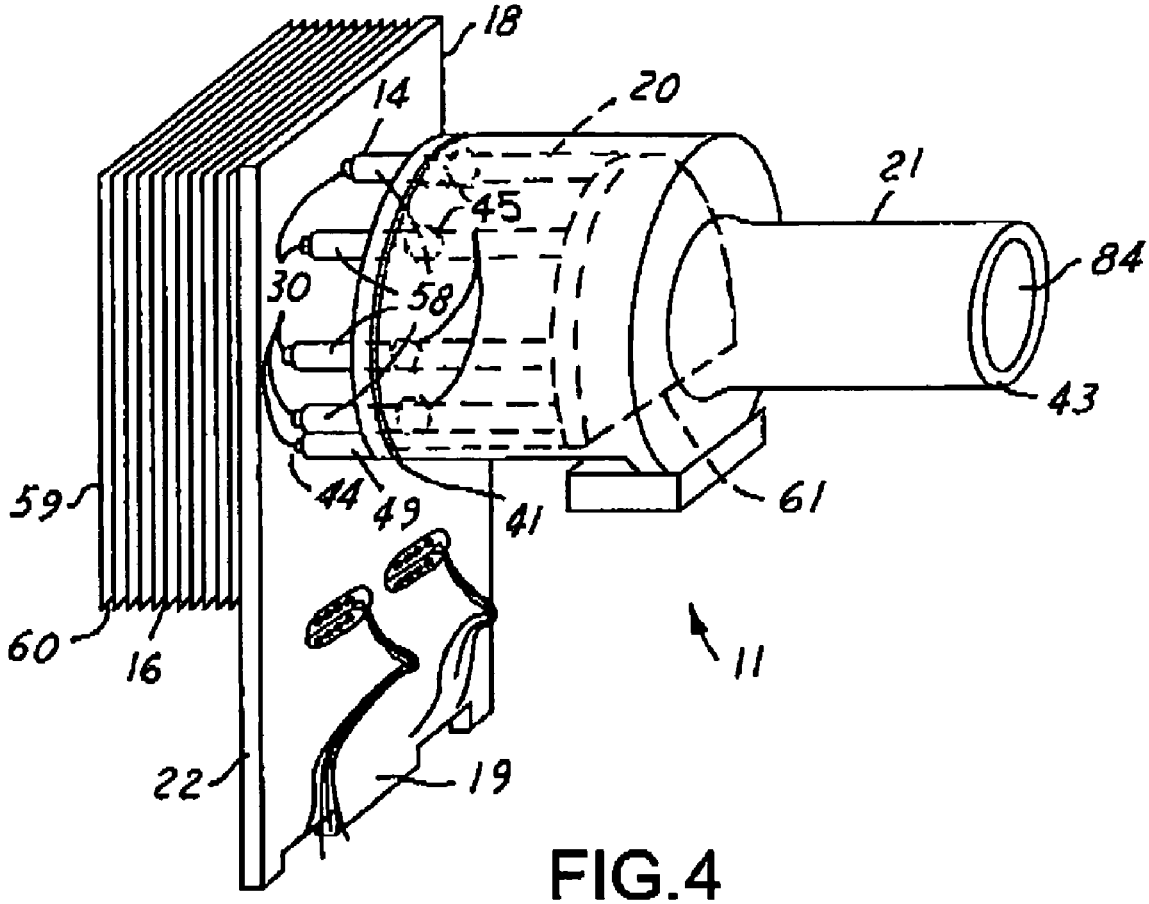
FIG. 4 is a perspective view of the heat pipe system of 3A including an X-ray shield according to another embodiment of the present invention.

Referring to FIG. 1, an X-Ray tube system 10 (X-Ray device) including a cooling system/heat pipe system 11 coupled to a metal housing 12, which supports other X-Ray tube components 13, in accordance with a preferred embodiment of the present invention, is illustrated.

The heat pipe system 11, which includes heat pipes 14 (heat conductors), heat conducting fins 16 (heat sink), a mounting plate 18, a sleeve 20 for the heat pipes 14, and an X-Ray shield 21 covering the sleeve 20, will be discussed in detail with regards to FIGS. 2, 3A, 3B, and 4.

The mounting plate 18 includes a first side 22 and opposing second side 19. The mounting plate 18 forms a cover and seal for the HV oil reservoir 61 (oil tank) also defined by the housing 12. This plate 18 is machined from a conductive material, for example an aluminum block, and has openings 30 drilled to draw out heat from the heat pipes 14 through thermodynamic heat transfer or through having the heat pipes extend therethrough and into a heat sink, i.e. the heat conducting fins 16.

The mounting plate 18 is illustrated with seven openings 30 defined therein in an arc-shaped manner. The illustrated openings 30 in the arc formation are merely one embodiment of the present invention. Numerous other configurations and arrangements of the openings 30 are embodied herein, such as polygonal openings having a polygonal arrangement.

The openings 30 are, in one embodiment, chambered on both sides. On the inside (i.e. the side in contact with oil 35) the chamber 44 is filled with epoxy based adhesive applied around the heat pipes 14, forming a first sealed layer. Similarly on the outer side (i.e. the side in contact with the heat conducting fins 16), the same adhesive can be applied around the heat pipes 14 thereby forming a leak proof joint.

In case of temperatures rising above the performance limit of the adhesive, O-Rings can be passed through the heat pipes 14 until the chamber and compressed by means of a metal plate inserted into the heat pipe system 11.

Referring to FIGS. 2, 3A, 3B, and 4, the heat pipes 14 (heat conductors) are illustrated with respect to pipes having circular cross-sections. This Is merely one embodiment of the present invention. Alternate embodiments of the heat pipes 14 include pipes having polygonal, semi-circular, or irregular cross-sections. Further, alternate lengths and diameters of the pipes 14 are included in alternate embodiments of the present invention, and the heat pipes 14 need not be uniform with respect to each other.

The heat pipes 14 are rated to handle the power dissipation with the desired temperature rise with around a 20% margin on power handling capacity. The pipes 14 are constructed from a ductile malleable corrosion-resistant diamagnetic metallic element, such as copper; however, almost any known electrical and thermal conductor may be used. The specification of one embodiment of the heat pipes 14 includes: a wire mesh capillary medium and water as the heat transfer fluid contained within the pipes.

The heat pipes 14 absorb the heat from the oil 35 as it flows into the sleeve 20. The temperature rise between two adjacent heat pipes 14 should be minimized in order to maintain the system temperature within proper system functioning limits, which are known in the art. Generally, the maximum temperature at the sleeve 20 is a function "f" of: the sleeve conductivity, sleeve thickness, distance between heat pipe, and fluid temperature at the boundary.

The thermally conductive sleeve 20 includes an interior 31 and an exterior 33 and is coupled to the plurality of heat pipes 14 such that the heat pipes 14 are arranged length-wise on the surface of the interior 31. The embodied sleeve 20 is generally arc-shaped and at least partially surrounds the X-Ray tube components 13 (including an X-Ray tube 23, an anode 28, and a cathode 25) and defines part of the dielectric oil reservoir 61, i.e. the sleeve 20 forms a boundary over the dielectric fluid.

The heat pipes 14 are spaced apart at some distances around the sleeve 20 and are coupled thereto, thereby enhancing heat transfer capacity between the pipes 14 and the sleeve 20. Semi-circular grooves 50 are machined in the sleeve 20 to seat the heat pipes 14 therein and to increase the metal contact between the heat pipes 14 and the sleeve 20.

The heat pipes 14 are arranged so that a larger number of pipes 14 are toward the top of the sleeve 20 because the hot oil 35 tends to rise, as will be understood by one skilled in the art.

The diameter of the sleeve 20 is determined in the present embodiment by the distance required from the anode surface 28 to the heat pipe surface 14 as dictated by the high voltage field strength present near the heat pipe surface 14 for initiating an electric discharge. The heat pipe 14 is the nearest metallic object at ground potential from the anode 28. This, however, is generally dependent on the dielectric strength of the oil 35, the temperature of oil 35, the profile of the sleeve 20, the presence of sharp edges and corners, and the potential of the anode 28 with respect to the ground potential of the heat pipes 14 and the sleeve 20.

Although the embodied sleeve profile is arc-shaped, alternate sleeve configurations include polygonal or irregular curve shapes.

The X-Ray shield 21 encloses the generally arc-shaped thermally conductive sleeve 20 and is arranged transaxially thereto. The X-Ray shield 21 further defines the dielectric oil reservoir 61 and includes a first end 41 and a second end 43. The first end 41 is circular and defines a plurality of openings 45 receiving the plurality of heat pipes 14 and is spaced a distance from the second side 19 of the mounting plate 18. The first end 41 is coupled to the generally arc-shaped thermally conductive sleeve 20 such that the sleeve 20 extends a portion of a distance between the first end 41 and the second end 43. The second end 43 defines an opening for X-Rays from the X-Ray tube components 13 to exit.

The first end 41 of the X-Ray shield 21 is embodied as separated from the mounting plate 18 by a gap 47, and mounted to the mounting plate through studs 49.

The ends of the pipes 14 adjacent the mounting plate 18 are shielded from the X-Rays emanating from the X-Ray tube 23 by means of this shield 21. The X-Ray shield 21 may be a high lead content brass material, which is cast and machined.

The sleeve 20 and the tube 23 are covered with the X-Ray shield 21, which is embodied as a continuous medium of lead having no or almost no openings other than the opening 84 at the second end 43.

The first end 41 of the X-Ray shield 21 is embodied as a disk having protruding collars 58 protruding from the disk and towards the mounting plate 18. The pipes extend through these collars 58, which are designed to reduce X-Ray seepage while improving the seal on the oil reservoir 61. Closer to the anode 28, the disk includes high lead content casting for the heat pipes 14 to enter.

The length of the collars 58 are such that incident X-Rays from the anode 28 falling on the openings 45 provided for the heat pipes 14 do not pass out directly. They instead impinge on the extended collars 58. This X-Ray shield 21 thus prevents the direct leakage of X-Rays from the anode 28.

Only a second X-Ray reflection, which is of lesser strength, passes out of the system, as will be understood by one skilled in the art. This is again prevented from going out of the system 10 by means of another lead sheet 59 placed over the last fin 60 of the heat sink.

To effectively dissipate anode heat without increasing the temperature beyond material limits, a heat transfer path having a low thermal resistance from the X-Ray tube 23 to the exterior of the system 11 is detailed herein below.

Heat transfer begins from the X-Ray tube 23 to the oil 35, which is surrounded by the oil 35. Both the anode 28 and the glass shell of the X-Ray tube 23 transfer heat to the oil 35 surrounding the X-Ray tube 23. Very high heat transfer coefficients are achieved at the X-Ray tube 23 and anode surfaces 28 by, for example, liquid immersion cooling.

Though the thermal conductivity of oil 35 is relatively small, the circulation caused by the oil buoyancy results in mixing of the oil 35, thereby maintaining an almost homogenous temperature distribution within the oil gap between the tube 23 and surrounding sleeve wall 24.

The surface area of the outer sleeve wall 24 is maximized to enhance the convective heat transfer from the oil 35. This convection generally follows: $Q=h\times A\times Tdiff$, where Q is the convection in Watts, h is the local convection coefficient, A is the surface area, and Tdiff is the temperature difference between the surface temperature and ambient temperature.

The heat transfer coefficient at the copper sleeve "Q" is enhanced by the effect of an HV field present in this zone, which causes the oil 35 to "vibrate" thereby breaking the boundary layer formed by the oil 35 at the sleeve wall 24.

The heat pipes 14 are embedded in the outer wall 24 of the sleeve 20. Heat transfer for the heat pipes 14 depend on the temperature distribution expected and the number of heat pipes 14 required to transfer a specific amount of heat. The sleeve 20 receives the heat over its entire area. This heat flows into the heat pipes 14 due to conduction along the sleeve wall 24. This causes a parabolic temperature distribution to occur at the wall segment 66 between the heat pipes 14.

Heat transfer along the heat pipes 14 contributes to a minimum temperature rise in the system 10. The temperature rise depends generally on the performance and orientation of the heat pipes 14. It also depends on the effectiveness of heat removal at the end having the heat conducting fins 16.

The heat pipes 14 extend out of the oil reservoir 61 through sealed interfaces. Because oil 35 fills the oil reservoir 61, it is sealed with gaskets, thereby preventing oil seepage. The heat pipes 14 exit though openings 45 in the mounting plate 18. The gap between the heat pipes 14 and the openings 45 are sealed internally with epoxy based adhesive capable of withstanding temperatures that the system 11 might experience. On the outside of the reservoir 61, the pipes 14 are sealed by means of O-rings sandwiched between the pipes 14 and a chamber created in the mounting plate 18.

The heat conducting fins (heat sink) 16 are embodied as thin aluminum fins 16 bonding the portion of the heat pipes 14 that is brought out of the oil reservoir 61. Important to note is that the fins 16 are just one embodiment of a heat sink device for dissipating heat from the pipes 14, and alternate embodiments include a conductive block or plurality of conductive blocks.

The area of contact between the pipes 14 and fins 16 is increased by plugging the contact area between the fins 16 and the pipes 14 with a heat conductor so that the thermal resistance at this interface is minimized. In addition to this an adhesive compound, e.g. an aluminum filled adhesive compound, is used to bond the pipes 14 and the fins 16, which further increases the heat transfer performance at this coupling. The pipes 14 may extend through the fins 16 or may alternately contact a portion of the fins 16 either directly or through an alternate sealed interface.

The heat conducting fins 16 are thus bonded to the heat pipes 14, and a blower 15 is used to force air through this arrangement. This forced air-cooling ensures effective removal of heat from the fins 16.

From the foregoing, it can be seen that there has been brought to the art a new cooling system 11. It is to be understood that the preceding description of the preferred embodiment is merely illustrative of some of the many specific embodiments that represent applications of the principles of the present invention. Numerous and other arrangements would be evident to those skilled in the art without departing from the scope of the invention as defined by the following claims.

The invention claimed is:

1. A cooling system for an imaging system comprising:

a mounting plate comprising a first side and an opposing second side, said mounting plate further defining at least one opening;

at least one heat conductor extending through said at least one opening and through at least a portion of a dielectric fluid reservoir defined adjacent said second side of said mounting plate and enclosing an X-Ray source, said at least one heat conductor absorbing heat from said dielectric fluid while not permitting said dielectric fluid to flow therein;

a thermally conductive sleeve coupled to said at least one heat conductor, said thermally conductive sleeve at least partially surrounding said X-Ray source, wherein said thermally conductive sleeve further defines at least one groove, wherein said at least one heat conductor is coupled to said thermally conductive sleeve at a surface of said groove; and a heat sink coupled to said first side of said mounting plate, said heat sink receiving at least a portion of said at least one heat conductor.

2. The system of claim 1, wherein said at least one heat conductor comprises a polygonal, semi-circular, or irregular cross-section.

3. The system of claim 1 further comprising a second heat conductor spaced apart from said first heat conductor and extending through a second opening defined in said mounting plate.

4. The system of claim 1 further comprising a plurality of spaced apart openings in said mounting plate arranged in an arc.

5. The system of claim 4, further comprising a plurality of heat conductors extending through said plurality of spaced apart openings.

6. The system of claim 1, wherein said heat sink comprises at least one of a plurality of thermally conductive fins coupled to said first side of said mounting plate and arranged parallel thereto, said plurality of thermally conductive fins receiving at least a portion of said at least one heat conductor, a plurality of thermally conductive blocks coupled to said first side of said mounting plate, or a solid thermally conductive block coupled to said first side of said mounting plate.

7. The system of claim 1 further comprising an X-Ray shield enclosing said thermally conductive sleeve and arranged trans-axially thereto.

8. The system of claim 7, wherein said X-Ray shield comprises a first end and a second end, said first end defining at least one opening receiving said at least one heat conductor, said first end spaced a distance from said second side of said mounting plate, said first end coupled to said thermally conductive sleeve such that said thermally conductive sleeve extends a portion of a distance between said first end and said second end, said second end defining an opening for X-Rays from said X-Ray source to exit.

9. The system of claim 8, wherein said first end further comprises at least one projection extending along a portion of a length of said heat conductor such that said projection limits incident X-Rays from exiting said X-Ray shield.

10. The system of claim 7, wherein said thermally conductive sleeve comprises at least one of a general arc-shape, a general polygonal-shape, or an irregular shape.

11. The system of claim 7 further comprising a second X-Ray shield coupled to said heat sink.

12. The system of claim 1, wherein said dielectric fluid comprises at least one of petroleum or silicone.

13. A cooling system for an imaging system including an X-Ray source contacting dielectric oil comprising:

a mounting plate comprising a first side and an opposing second side, wherein only said second side contacts the dielectric oil, said mounting plate further defining a plurality of openings spaced apart from each other;

a plurality of heat pipes extending through said plurality of openings, whereby said plurality of heat pipes contact the dielectric oil;

a plurality of thermally conductive fins coupled to said first side of said mounting plate, said plurality of thermally conductive fins receiving at least a portion of each of said plurality of heat pipes; and an X-Ray shield within the dielectric oil surrounding the X-Ray source, said X-Ray shield comprising a first end and a second end, said first end defining a plurality of openings receiving said plurality of heat pipes, said first end spaced a distance from said second side of said mounting plate, said second end defining an opening for X-Rays from the X-Ray source to exit.

14. The system of claim 13 further comprising a generally arc-shaped thermally conductive sleeve comprising an interior and an exterior coupled to said plurality of heat pipes such that said plurality of heat pipes are arranged lengthwise on a surface of said interior, said generally arc-shaped thermally conductive sleeve at least partially surrounding the X-Ray source.

15. The system of claim 13, wherein said X-Ray shield encloses said generally arc-shaped thermally conductive sleeve and is arranged trans-axially thereto.

16. The system of claim 13, wherein said first end of said X-Ray shield is coupled to said generally arc-shaped thermally conductive sleeve such that said generally arc-shaped thermally conductive sleeve extends a portion of a distance between said first end and said second end of said X-Ray shield.

17. The system of claim 13, wherein said mounting plate defines said plurality of openings spaced apart from each other in an arc arrangement.

18. A cooling system for an imaging system including an X-Ray source comprising:

a housing for the imaging system defining a dielectric oil reservoir enclosing the X-ray source;

a mounting plate coupled to said housing, said mounting plate comprising a first side and an opposing second side such that said second side defines a boundary of said dielectric oil reservoir, said mounting plate further defining a plurality of openings spaced apart from each other in an arc formation;

a plurality of heat pipes extending through said plurality of openings, whereby said plurality of heat pipes contact the dielectric oil;

a plurality of thermally conductive fins coupled to said first side of said mounting plate and arranged parallel thereto, said plurality of thermally conductive fins receiving at least a portion of each of said plurality of heat pipes;

a generally arc-shaped thermally conductive sleeve comprising an interior and an exterior, said arc-shaped thermally conductive sleeve coupled to said plurality of heat pipes such that said plurality of heat pipes are arranged lengthwise on a surface of said interior, said generally arc-shaped thermally conductive sleeve enclosed within said housing and at least partially surrounding the X-Ray source; and an X-Ray shield enclosing said generally arc-shaped thermally conductive sleeve and arranged trans-axially thereto within said housing, said X-Ray shield comprising a first end and a second end, said first end defining a plurality of openings receiving said plurality of heat pipes, said first end spaced a distance from said second side of said mounting plate, said first end coupled to said generally arc-shaped thermally conductive sleeve such that said generally arc-shaped thermally conductive sleeve extends a portion of a distance between said first end and said second end, said second end defining an opening for X-Rays from the X-Ray source to exit said X-Ray shield.

* * * * *